US010988932B2

(12) United States Patent
Allesen

(10) Patent No.: US 10,988,932 B2
(45) Date of Patent: Apr. 27, 2021

(54) CLOSURE FOR A CLADDING FOR A ROOF WINDOW AND A ROOF WINDOW ARRANGEMENT

(71) Applicant: VKR Holding A/S, Hørsholm (DK)

(72) Inventor: Torben Krogsgaard Allesen, Horsens (DK)

(73) Assignee: VKR Holding A/S

( * ) Notice: Subject to any disclaimer, the term of this patent is extended or adjusted under 35 U.S.C. 154(b) by 0 days.

(21) Appl. No.: 16/737,811

(22) Filed: Jan. 8, 2020

(65) Prior Publication Data

US 2020/0224422 A1 Jul. 16, 2020

(30) Foreign Application Priority Data

Jan. 10, 2019 (DK) ..... PA 2019 70016

(51) Int. Cl.
*E04D 13/03* (2006.01)
*E04D 13/147* (2006.01)
*E06B 7/23* (2006.01)

(52) U.S. Cl.
CPC ..... *E04D 13/0315* (2013.01); *E04D 13/031* (2013.01); *E04D 13/1475* (2013.01); *E06B 7/2312* (2013.01)

(58) Field of Classification Search
CPC ..... E04D 13/0315; E04D 13/1475; E04D 13/031; E04D 13/03; E04D 3/366; E04D 13/00; E06B 7/2312
See application file for complete search history.

(56) References Cited

U.S. PATENT DOCUMENTS 2,851,973 A * 9/1958 Lenke ..... E04B 5/46 52/200
4,520,604 A * 6/1985 Halsey ..... E04D 13/031 52/200

(Continued)

FOREIGN PATENT DOCUMENTS

CA 2881561 A1 * 12/2015 ..... E06B 7/2303
DE 7829553 1/1979

(Continued)

OTHER PUBLICATIONS

Danish Search Report issued in Danish Patent Application No. PA2019 70015 dated Jun. 6, 2019, four pages.

(Continued)

*Primary Examiner* — Jessie T Fonseca
(74) *Attorney, Agent, or Firm* — Merek, Blackmon & Voorhees, LLC

(57) ABSTRACT

An end closure for a cladding for a first roof window forming part of a roof window arrangement mounted in an inclined roof structure, where said first roof window is above a second roof window when seen in the direction of inclination of the roof structure and where a middle flashing member is arranged between the roof windows is disclosed. The end closure comprises an end plug having a male connector section configured to be inserted in a hollow section of the cladding and an end gasket configured to come into a sealing engagement with the middle flashing member. The end gasket is arranged at the interior side of the end plug and extending from one side surface to the other. The end closure may further include a covering plug configured for interconnecting the end plug with a covering extending along a lower edge of the first roof window.

20 Claims, 6 Drawing Sheets

(56) References Cited

U.S. PATENT DOCUMENTS

Figure 1:
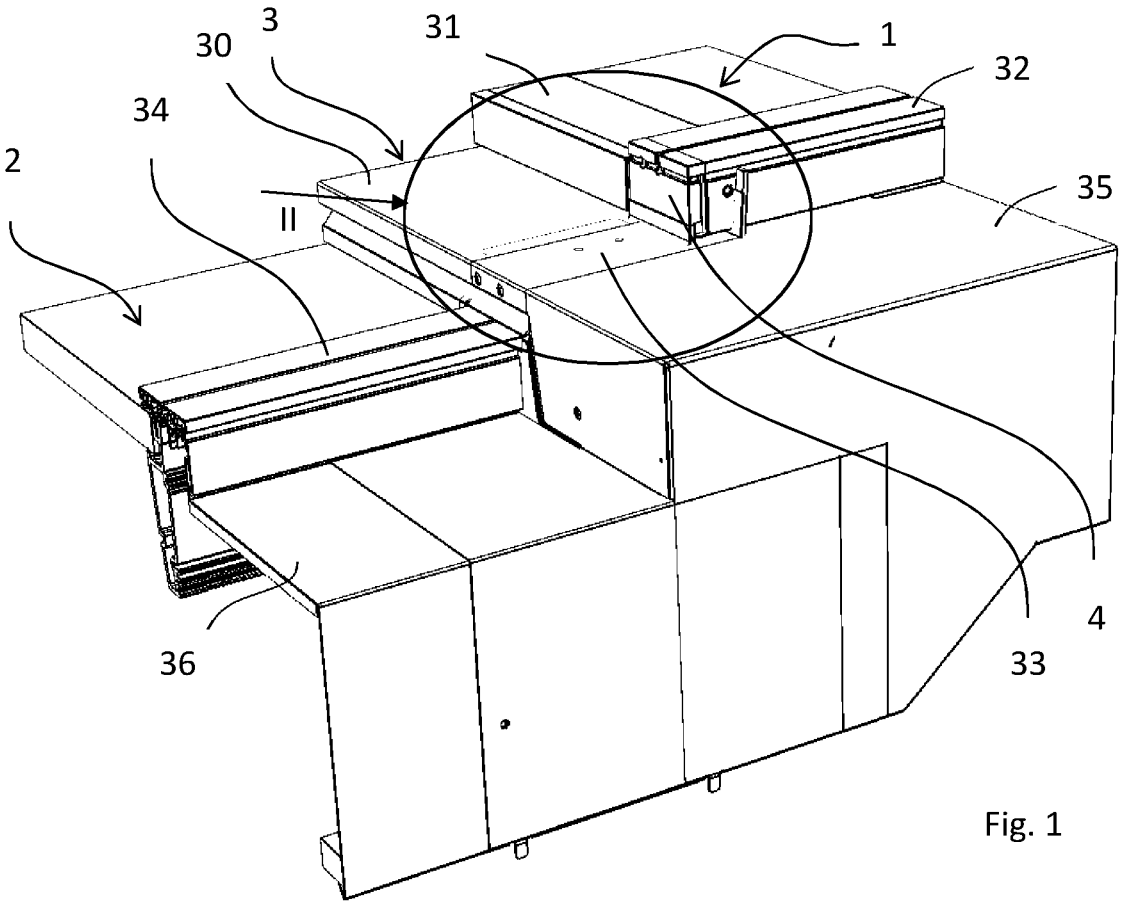

| | | | | | |
|---|---|---|---|---|---|
| 4,570,393 | A * | 2/1986 | Minter | E04D 13/031 | 49/483.1 |
| 4,621,466 | A | 11/1986 | Sonneborn | | |
| 4,776,141 | A * | 10/1988 | Powell | E04D 13/031 | 52/200 |
| 5,044,133 | A * | 9/1991 | Sampson | E04D 13/0354 | 52/72 |
| 5,150,983 | A * | 9/1992 | Bogenhagen | E04D 13/0305 | 403/295 |
| 5,355,644 | A * | 10/1994 | Guhl | E04D 13/0305 | 52/200 |
| 5,682,713 | A * | 11/1997 | Weiss | E04D 13/031 | 403/231 |
| 5,913,785 | A * | 6/1999 | Møller et al. | E04D 13/0305 | 49/DIG. 1 |
| 6,052,956 | A * | 4/2000 | Hoy | E04D 13/03 | 52/200 |
| 6,195,948 | B1 * | 3/2001 | Lamanna | E04D 13/0305 | 52/200 |
| 6,263,623 | B1 * | 7/2001 | Weiss | E04D 13/02 | 49/463 |
| 6,263,624 | B1 * | 7/2001 | Hoy | E04D 13/03 | 52/200 |
| 7,658,356 | B1 | 2/2010 | Nehls | | |
| 9,920,532 | B1 * | 3/2018 | Conklin | E06B 3/6715 | |
| 2010/0269426 | A1 * | 10/2010 | Richter | E04D 13/0315 | 52/171.3 |
| 2011/0277402 | A1 | 11/2011 | Schnitzer | | |
| 2012/0167483 | A1 | 7/2012 | Lindgren et al. | | |
| 2014/0305046 | A1 | 10/2014 | Stearns et al. | | |
| 2014/0366468 | A1 | 12/2014 | Lindgren et al. | | |
| 2015/0267412 | A1 | 9/2015 | McClure | | |

FOREIGN PATENT DOCUMENTS

| | | | | |
|---|---|---|---|---|
| DE | 7920893 | | 11/1986 | |
| DE | 19517557 | A1 * | 11/1996 | E04D 13/1478 |
| DE | 20206327 | | 7/2002 | |
| DE | 202012006688 | | 10/2013 | |
| DE | 202014000149 | | 5/2014 | |
| DK | 201670572 | | 3/2018 | |
| EP | 0087647 | | 9/1983 | |
| EP | 0428921 | | 5/1991 | |
| EP | 1533436 | | 5/2005 | |
| EP | 2472025 | | 7/2012 | |
| EP | 2472043 | | 7/2012 | |
| EP | 2752531 | | 7/2014 | |
| EP | 3039198 | | 7/2016 | |
| EP | 3252256 | | 12/2017 | |
| EP | 3282064 | | 2/2018 | |
| WO | WO 2004/055294 | | 7/2004 | |
| WO | WO2005/116365 | | 12/2005 | |
| WO | WO 2015/028032 | | 3/2015 | |
| WO | WO2015028030 | | 3/2015 | |

OTHER PUBLICATIONS

Danish Search Report issued in Danish Patent Application No. PA2019 70016 dated Aug. 27, 2019, four pages.
Danish Search Report issued in Danish Patent Application No. PA2019 70013 dated Jun. 28, 2019, four pages.
Danish Search Report issued in Danish Patent Application No. PA2019 70014 dated Jun. 25, 2019, four pages.
Machine generated translation of DE7829553, Jan. 18, 1979.
Machine generated translation of DE202012006688, Oct. 14, 2013.
Machine generated translation of DE7920893, Nov. 13, 1986.
European Search Report Dated May 25, 2020, 5 Pages Issued in Connection With European Application No. 20150912 Which is Related to U.S. Appl. No. 16/737,802.
European Extended Search Report Dated Jun. 16, 2020, 5 Pages Issued in Connection With European Application No. 20150914 Which is Related to U.S. Appl. No. 16/737,811.
European Extended Search Report Dated Apr. 23, 2020, 8 Pages Issued in Connection With European Application No. 20150910 Which is Related to U.S. Appl. No. 16/737,820.
European Extended Search Report Dated May 29, 2020, 8 Pages Issued in Connection With European Application No. 20150909 Which is Related to U.S. Appl. No. 16/737,834.
Machine generated translation of DE202014000149, May 20, 2014.

* cited by examiner

CLOSURE FOR A CLADDING FOR A ROOF WINDOW AND A ROOF WINDOW ARRANGEMENT

The present invention relates to an end closure for a cladding for a first roof window forming part of a roof window arrangement mounted in an inclined roof structure, where said first roof window is above a second roof window when seen in the direction of inclination of the roof structure, said end closure comprising an end plug having an inner side intended to face the cladding in the mounted state, an outer side intended to face away from the cladding, an interior side intended to face the interior of a building covered by the roof structure, an exterior side intended to face the exterior, and two side surfaces, which are substantially perpendicular to the inner, outer, interior and exterior surfaces, and said end plug comprising a male connector section configured to be inserted in a hollow section of the cladding. The invention further relates to a roof window arrangement and to a method for weather-proofing a roof window arrangement.

End closures of this type are known, but it remains a problem to achieve satisfactory weather-proofing of large roof windows mounted in groups, where two or more roof windows are mounted in continuation of each other when seen in the direction of inclination of the roof structure. Particularly, it has been a problem to achieve sufficient water-tightness during heavy winds when the inclination of the roof structure is below 25 degrees.

It is therefore the object of the invention to provide an end closure, which provides improved tightness to roof window arrangements mounted in roof structures with low inclinations.

This is achieved with an end closure as described above which further comprises an end gasket arranged at the interior side of the end plug and extending from one side surface to the other and being configured to come into a sealing engagement with a middle flashing member arranged between the first roof window and the second roof window in the mounted state.

In this context "middle flashing member" not only includes a flashing member extending along the entire width of the roof windows. It also includes a connector flashing member interconnecting such a flashing member with one or more side flashing member(s) extending along sides of the roof windows in parallel with the inclination of the roof structure, or with another middle flashing member.

Traditionally the end plugs have either been considered sufficient in themselves and/or they have been made of a soft material sealing against the flashing member(s). Experiments have, however, shown that by providing an end plug with a gasket it is possible to combine a tight engagement with the flashing member(s) with the formation of a wind pressure relief space behind the end closure. This space slows down any wind reaching past the gasket, thus considerably reducing the risk of water being pressed into the structure of the roof window and/or the roof structure.

In one embodiment the end plug is provided with one or more flanges extending from the inner side. Such flanges may serve as male connector sections and mate with flanges or cavities on the cladding thereby helping to establish a connection between the end closure and the cladding. The flanges may also or alternatively serve to divide the space behind the end plug in two or more chambers. Such smaller chambers may in themselves serve to slow down wind, and together they may form a labyrinth having a shape, which hinders wind penetration. They may also function as pressure relief chambers.

An alternative is to provide the end plug with other types of projections and/or with depressions. Moreover, the interior side of the cladding and/or other components of the first roof window may also contribute to the formation of one or more chambers.

The interconnection of the end plug and the end gasket may be achieved in numerous ways. In one embodiment, the end gasket comprises one or more female connector sections fitting over an engagement section of the end plug. This provides for a reliable, yet simple interconnection of the end plug with the gasket. One example of an engagement section is a flange extending in parallel with the outer side of the end plug.

In order to make sure that the end plug and the end gasket remain interconnected, the end plug and the end gasket may be provided with matching engagement members. In one example a female connector section of the end gasket is provided with female engagement members, which fit over male engagement members on an engagement section of the end plug and come into a snap-locking engagement with them, when the end plug and the end gasket are interconnected.

The end plug is preferably made from a dimensionally stable material, such as aluminium, a high-density polymer, and/or a thermoplastic resin, and will typically be made from moulding, possibly moulding two or more parts separately and interconnecting them afterwards. In one embodiment the end plug is made injection moulding a thermoplastic resin. The moulding material may for example be Xenoy, which is a blend of polycarbonate (PC) and polybutylene terephthalate (PBT), where the product sold under the name Xenoy CL100 have been used with good results. Alternative materials are acrylonitrile styrene acrylate (ASA), polyamid (PA), specifically PA 6 with a UV stabilizer, and acrylonitrile butadiene styrene (ABS). In most cases it will be advantageous to add an UV stabilizer, which increases the resistance of the material to ultra-violet radiation, and/or an additive increasing the temperature resistance of the material, specifically making the material better suited for use at temperatures below 0 degrees Celsius. Combinations of materials and composites, where for example a metal or a fibrous material is used for reinforcing a polymer, may also be employed.

The end gasket is made from an elastic material, such as rubber. At present a vulcanized thermoplastic elastomer (TPV) is preferred, and specifically a vulcanised ethylene propylene diene monomer (EPDM) in a matrix of polypropylene (PP). Such a product is sold under the name Santoprene TPV 121-85. Most types of thermoplastic elastomers (TPE) may in principle be used, but TPV's are presently considered advantageous as they generally have a relatively high resistance to ultraviolet radiation. Other elastomers may also be used. Fibers or inlays may be used for reinforcing the end gasket, possibly giving different parts of the end gasket different physical properties.

The part of the end gasket, which faces away from the end plug may be provided with a lip section adapted for sealing engagement with the middle flashing member. This provides good tightness while at the same time allowing the part of the end gasket engaging with the end plug to be made with less flexibility. The lip section may be made from a material with different properties that the rest of the end gasket, particularly a relatively higher elasticity may be advantageous.

The end closure may further include a covering plug configured for interconnecting the end plug with a covering extending along a lower edge of the first roof window and comprising a male connector sections configured to be inserted in a hollow section of the covering. This embodiment allows the cladding and the covering, which will also be referred to as the bottom covering of the first roof window, to be interconnected, thereby contributing further to the tightness of the roof window by reducing the risk of a relative displacement of the covering and the cladding.

The covering plug may also contribute to the formation of a labyrinth within the end closure. For this purpose, the covering plug may comprise an engagement surface configured to come into engagement with one or more flanges on the inner side of the end plug so that a space is formed between the covering plug and the end plug in the mounted state. This will be described in more detail below with reference to the drawing.

In a still further embodiment, the covering plug comprises a covering gasket attachment section adapted for attachment of a covering gasket extending substantially in parallel with the end gasket in the mounted state. This may help provide a transition between the sealing provided on the bottom covering and the sealing provided by the end closure. The covering gasket and end gaskets may abut end-to-end, but it is presently preferred that the gaskets overlap, the end gasket preferably being arranged on the outer side of the covering gasket in the mounted state. A lip section of the end gasket may be in contact with the covering gasket in the mounted state.

The covering gasket is made from an elastic material, such as rubber. At present ethylene propylene diene monomer (EPDM) is preferred as it provides a good combination of resistance to ultra violet radiation, temperature and mechanical wear. A vulcanized thermoplastic elastomer (TPV) or another elastomer may, however, also be used. Fibers or inlays may be used for reinforcing the covering gasket, possibly giving different parts different physical properties.

A second aspect of the invention relates to a roof window arrangement mounted in an inclined roof structure including at least a first roof window and a second roof window and a middle flashing member arranged between the first roof window and the second roof window, where the first roof window is mounted above a second roof window when seen in the direction of inclination of the roof structure, said first roof window comprising a cladding and an end closure on the cladding, said end closure comprising an end plug having an inner side facing the cladding, an outer side facing away from the cladding, an interior side facing the interior of a building covered by the roof structure, an exterior side facing the exterior, and two side surfaces, which are substantially perpendicular to the inner, outer, interior and exterior surfaces, and said end plug comprising a male connector sections inserted in a hollow section of the cladding, where the end closure further comprises an end gasket arranged on the interior side of the end plug and extending from one side surface to the other and being in a sealing engagement with the middle flashing member.

Embodiments and advantages described with reference to one aspect of the invention also applies to the other aspects of the invention unless otherwise stated.

Figure 2:
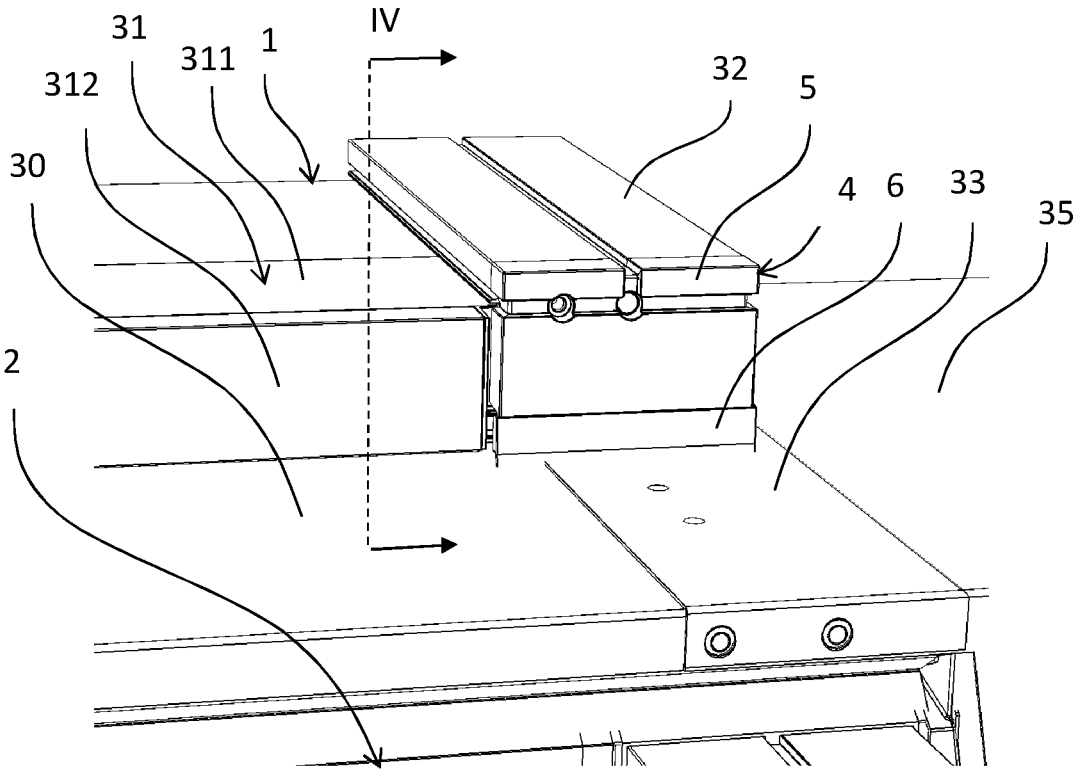
Figure 3:
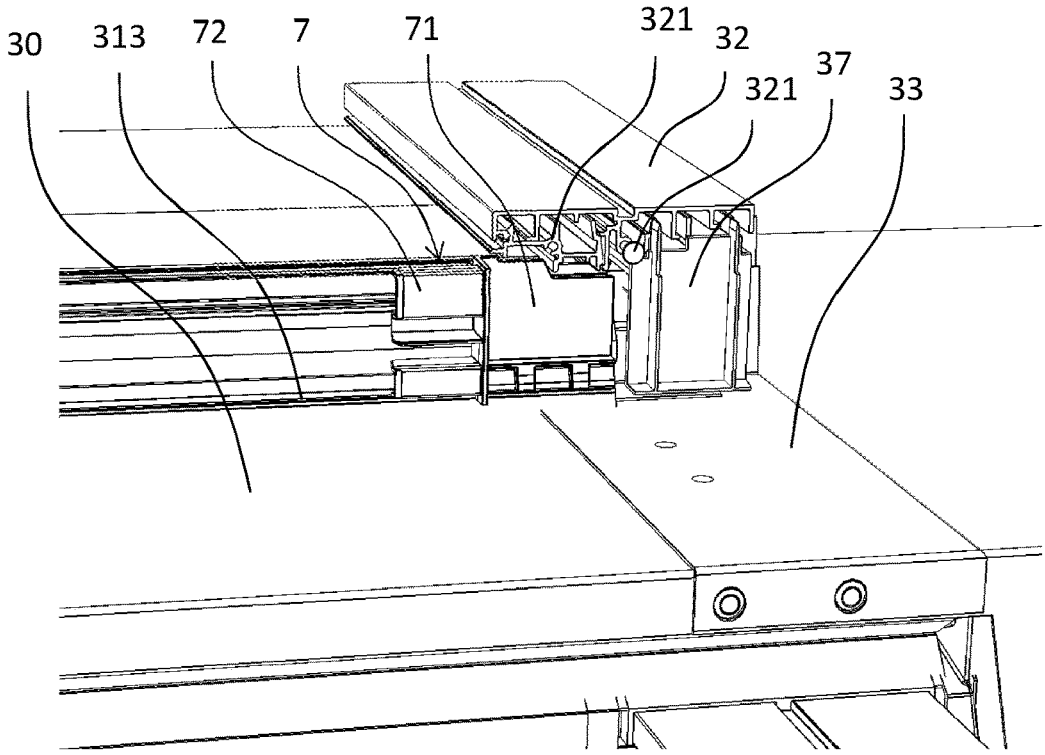
Figure 4:
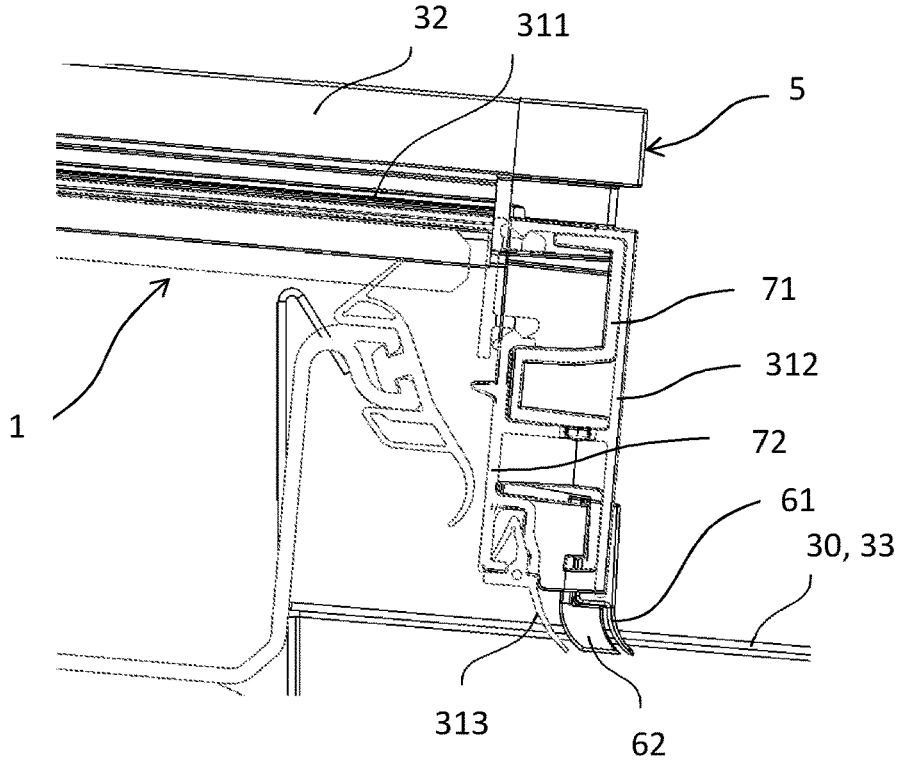
Figure 5:
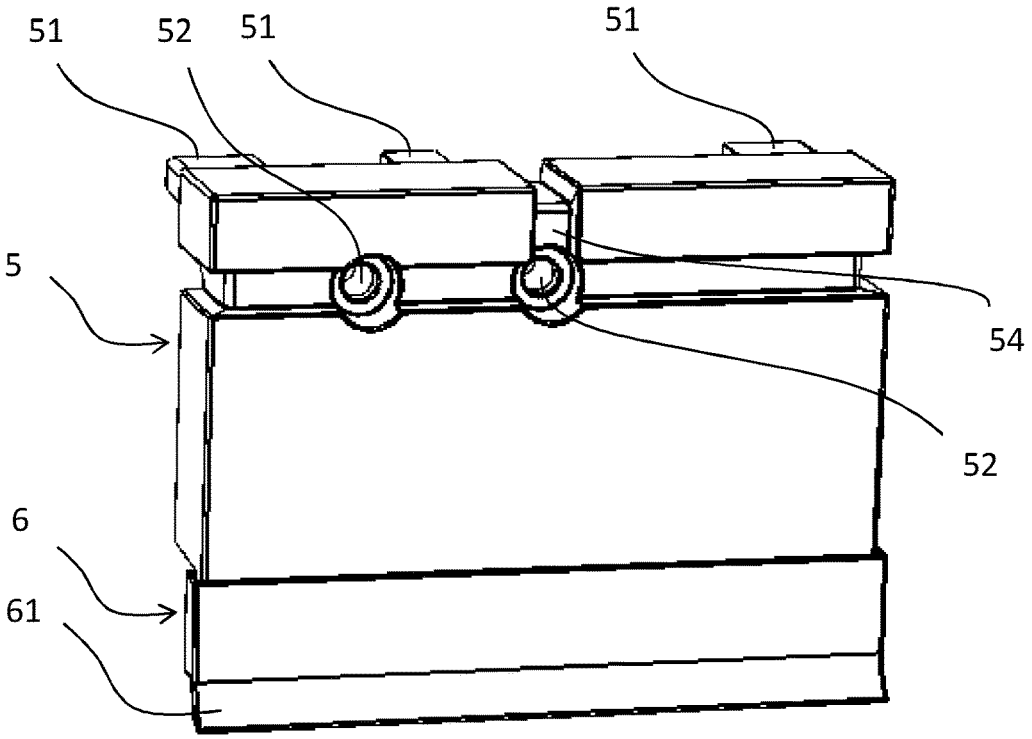
Figure 6:
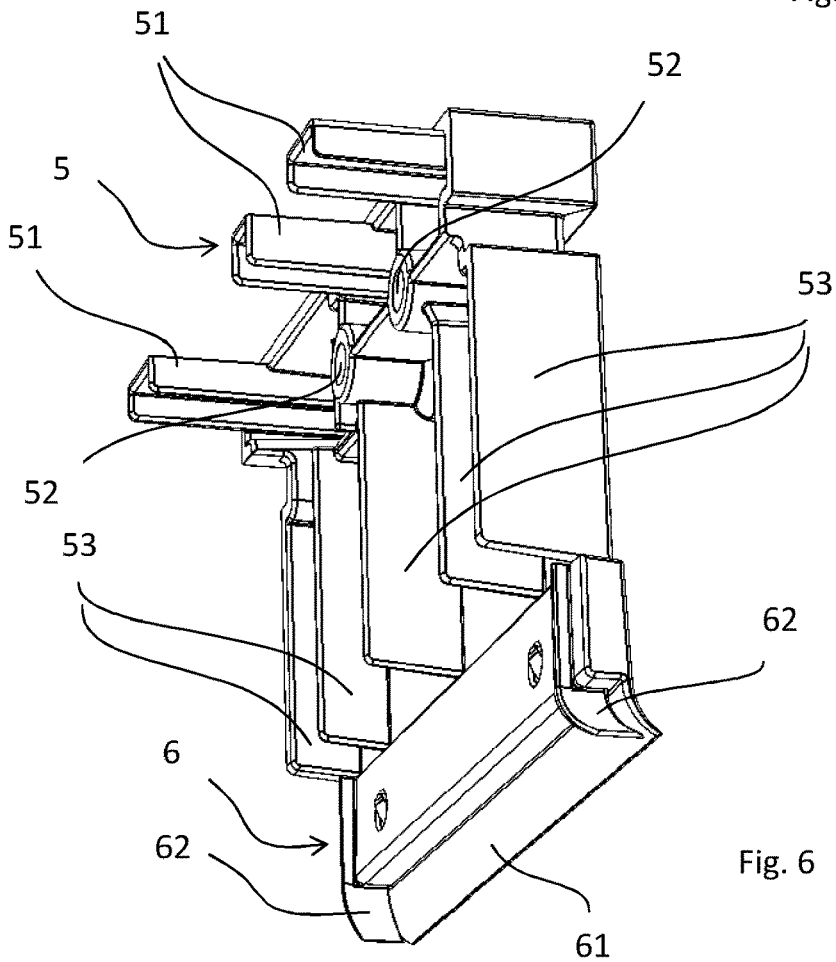
Figure 7:
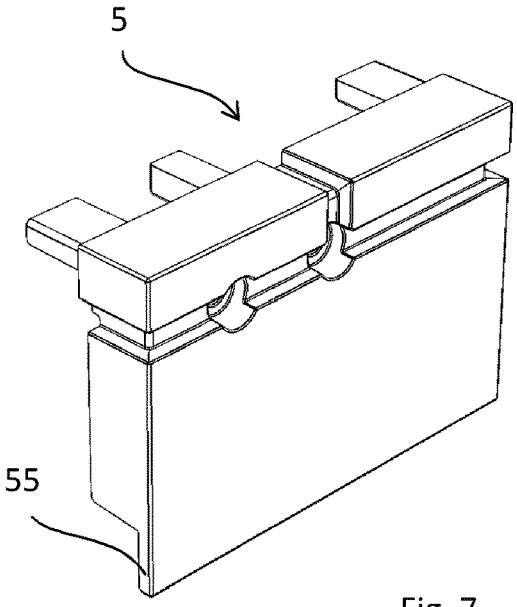
Figure 8:
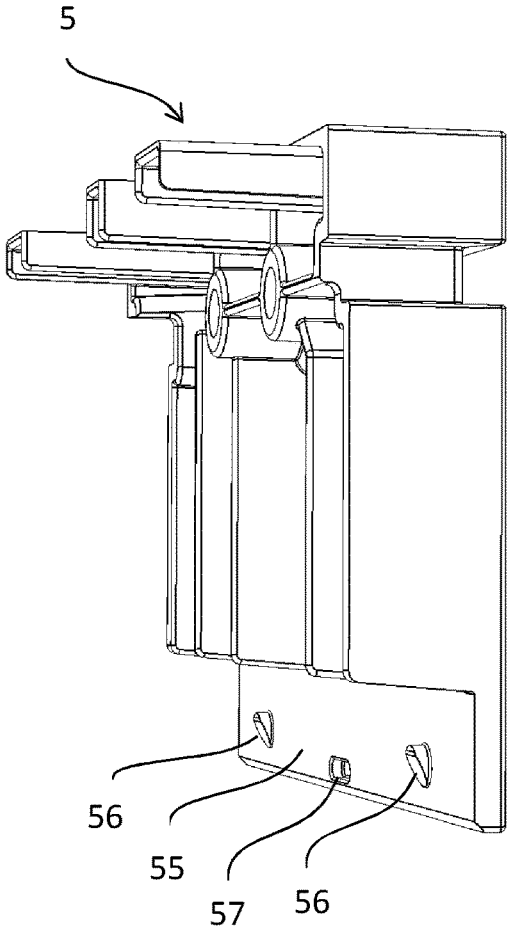
Figure 9:
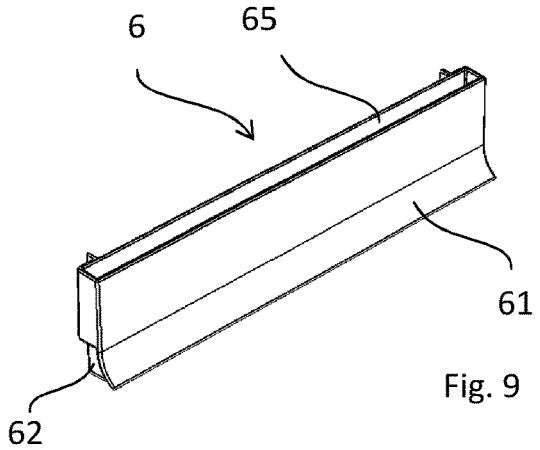
Figure 10:
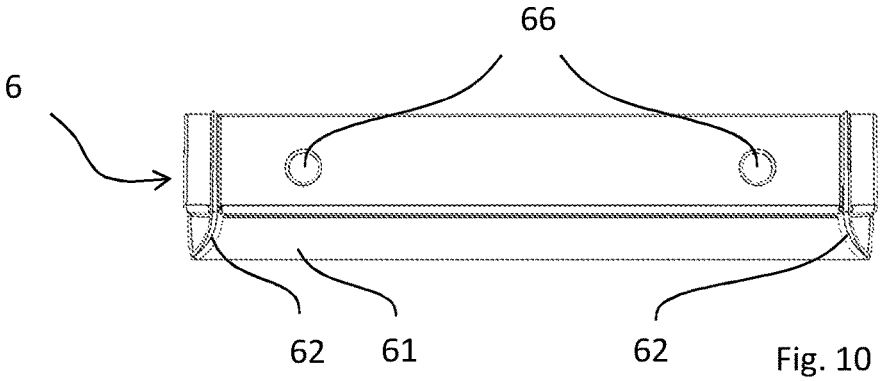
Figure 11:
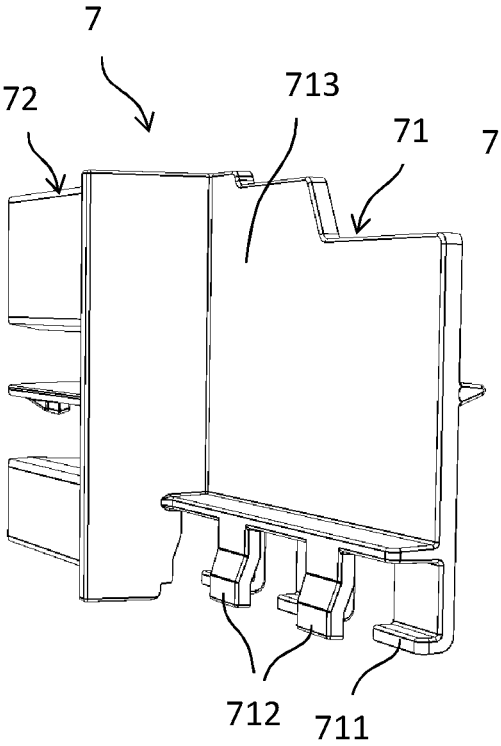
Figure 12:
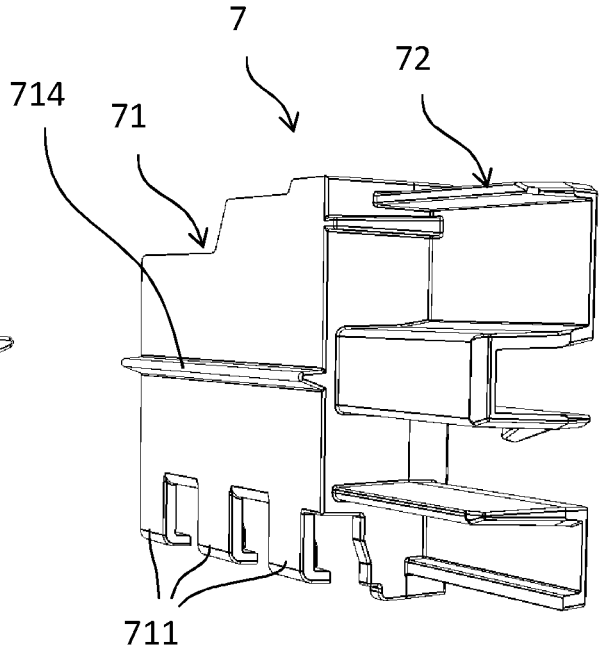
Figure 13:
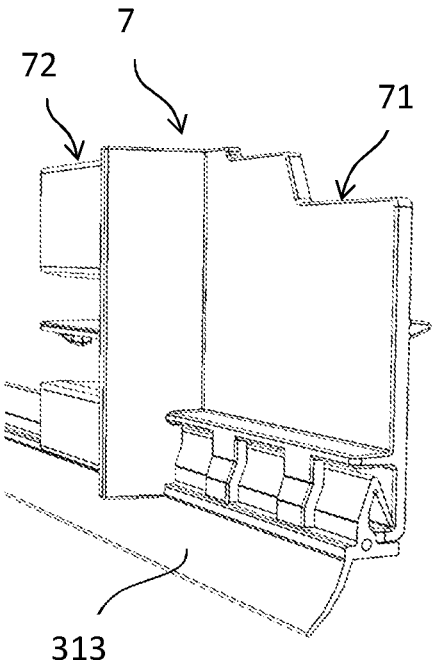
Figure 14:
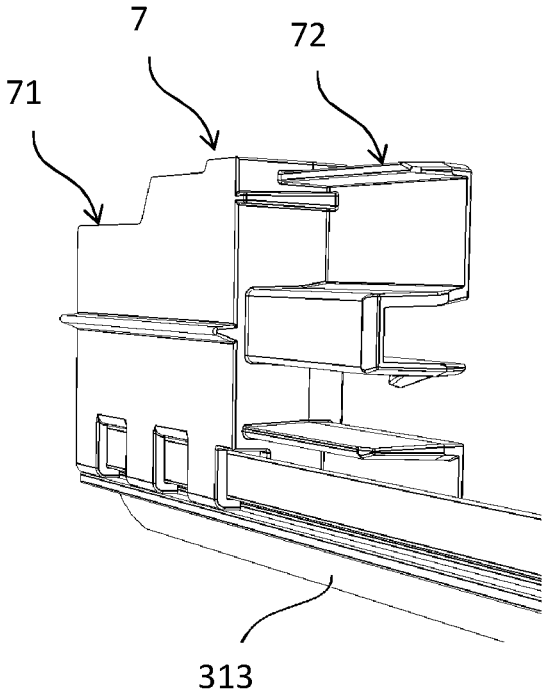
Figure 15:
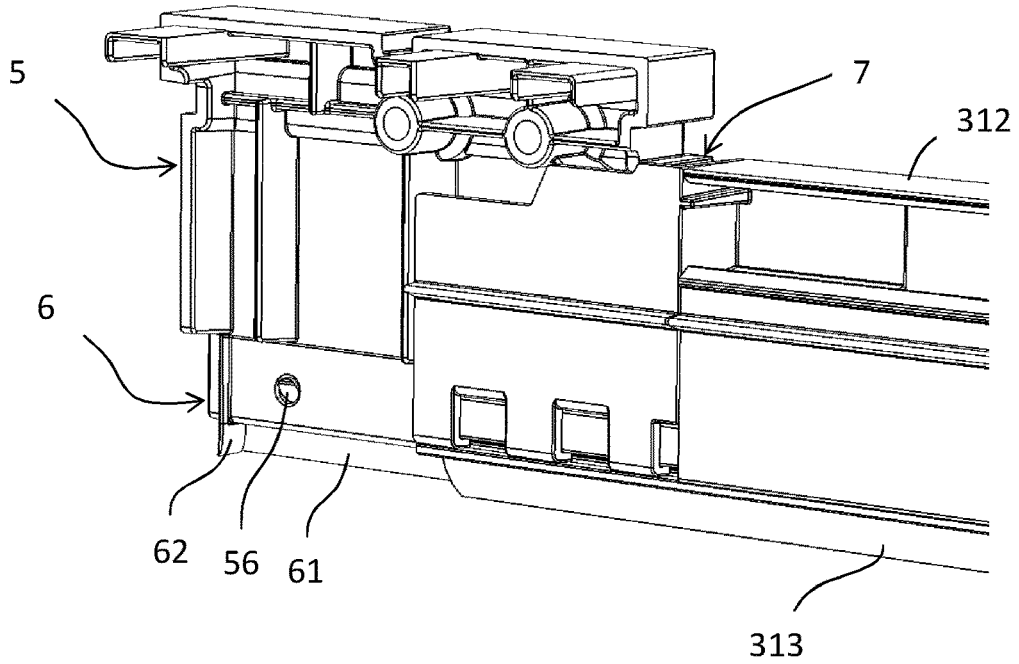

In the following the invention will be described in more detail with reference to the non-limiting embodiments shown in the drawing, where:

FIG. 1 is a perspective partially cut-away view of a roof window arrangement according to the invention, FIG. 2 shows the detail marked II in FIG. 1, FIG. 3 corresponds to FIG. 2 but with the end plug, end gasket and bottom covering of the first roof window removed, FIG. 4 is a cross-section along the line IV in FIG. 2, FIG. 5 is a perspective view of an end closure according to the invention, FIG. 6 is a perspective view of the end closure in FIG. 5 from another angle, FIG. 7 is a perspective view of the end plug of the end closure in FIGS. 5 and 6, FIG. 8 is a perspective view of the end plug in FIG. 7 from another angle, FIG. 9 is a perspective view of the end gasket of the end closure in FIGS. 5 and 6, FIG. 10 is a perspective view of the end gasket in FIG. 9 from another angle, FIG. 11 is a perspective view of a covering plug, FIG. 12 is a perspective view of the covering plug in FIG. 11 from another angle, FIG. 13 is a perspective view of the covering plug in FIGS. 11-12 and a covering gasket, FIG. 14 is a perspective view of the covering plug and the covering gasket in FIG. 13 from another angle, FIG. 15 is a perspective view of the end enclosure, bottom covering and bottom gasket in FIGS. 1, 2 and 4, and FIG. 16 is a perspective view of the end enclosure, bottom covering and bottom gasket in FIG. 15 from another angle.

A roof window arrangement in an inclined roof structure including a first roof windows 1 located above a second roof window 2 when seen in the direction of inclination of the roof structure is seen in FIG. 1. In addition to the roof windows, it comprises a flashing assembly 3 which includes a middle flashing member 30 extending between the two roof windows, a bottom covering 31 and a cladding 32 on the first window, a cladding 34 on the second window, side flashing members 35, 36 at the first and second roof windows, respectively. Furthermore, it includes a connector flashing member 33 extending between the middle flashing member 30 and the side flashing member 35 of the first roof window 1 and between the claddings 32, 34 on the two windows.

The detail marked II is shown in FIG. 2 from the direction indicated by the arrow. As is better seen here, an end closure 4 is provided at the end of the cladding 32 on the first roof window 1, and the bottom covering 31 comprises two parts, a first part 311 extending in plane with the pane of the first roof window and a second part 312 extending down towards the middle flashing member 30 substantially in parallel with the end closure 4.

As is also seen in FIGS. 5 and 6 the end closure 4 comprises an end plug 5 and an end gasket 6. The end plug 5 is made from a dimensionally stable material, such as aluminium or a polymer and is interconnected with the cladding as will be described below. The end gasket 6 is made from an elastic material, such as rubber, and is in sealing engagement with the connector flashing member 33, which in this context is regarded as a middle flashing member as it too extends between the two roof windows 1, 2.

In this embodiment the end closure 4 further includes a covering plug 7, which is hidden behind the covering 31, the end plug 5 and the end gasket 6 in FIG. 2, but may be seen in FIG. 3, where these items have been removed.

The covering plug 7 comprises a first section 71, which is arranged at the end of the cladding 32, and a second section 72, which extends into the second part 312 of the covering.

The covering plug thus bridges the gap between the end plug 5 and the covering 31 as will also be described later. A tight connection between the end plug 5 and the covering 31 can, however, also be achieved in other ways, for example be the use of a gasket.

It is noted that the cladding 32 shown in FIGS. 1-3 is intended to be able to span over a gap between two roof windows mounted side-by-side and therefore has the twice the width necessary in this embodiment, where no roof window is mounted to the side of the first roof window 1. The space, which would have been occupied by the sash of a neighbouring roof window, is here filled out by a filler profile 37. If using a cladding (not shown) having only half the width, the filler profile 37 would be left out and the end plug 5 and end gasket 6 would have only half the width of what is shown in the drawing.

The relative position between the cladding 32, the end plug 5, the end gasket 6, the covering 31, the covering plug 7, and the middle flashing member 30 is shown in FIG. 4. In this figure as well as in FIG. 2 and in the remaining figures, the end gasket 6 is shown in its undeformed state. It is to be understood that the lip section 61 and side lips 62 will be pressed slightly upwards and outwards by the flashing member 30, 33. The same applies to the covering gasket 313, which is provided at the interior edge of the second part 312 of the covering 31 and extending into the second part 72 of the covering plug 7 as will be described later.

The end plug 5 and end gasket 6 are shown in more detail in FIGS. 5-10.

The end plug 5 comprises a male connector section here represented by three projections 51 having the shape of inverted U's, each configured to be inserted in a groove on the interior side of the cladding 32. Friction between these projections and grooves may be sufficient to keep the end closure 4 in place, but in this embodiments the end plug 5 is further provided with openings 52 allowing the insertion of screws or like fasteners, so that they may engage precisely with receivers 321 in the cladding (shown in FIG. 3).

The end plug 5 is further provided with five flanges 53 extending from the inner side. One or more of these flanges may also be involved in establishing a connection to the cladding 32 or other parts of the first roof window, but their primary purpose is to provide chambers on the inner side, which will contribute to hindering wind penetration into the roof window structure.

At the interior side the end plug 5 is provided with an engagement section in the form of a flange 55 extending in parallel with the outer side and fitting into a female connector section 65 in the end gasket 6. Projections 56 on the engagement section 55 fit into openings 66 in the end gasket 6 and an opening 57 fits with a projection (not visible) on the inside of the groove forming the female connector section 65. When the elastic end gasket 6 is arranged on the end plug 5, these projections snap into the respective openings, thus fixating the end gasket 6 in relation to the end plug 5.

The end gasket 6 is provided with a lip section 61 extending over the entire width of the gasket as described above and side lips 62 are provided at both sides. These side lips 62 hinder wind and water etc. in passing around the lip section 61 and, as seen in FIG. 4, they close the gap between the end gasket 6 and the covering gasket 313 extending along the bottom covering 31. The side lips also help stabilise the lip section 61 so that the risk of it being bent inwards towards the cladding when mounted is reduced.

Figure 16:
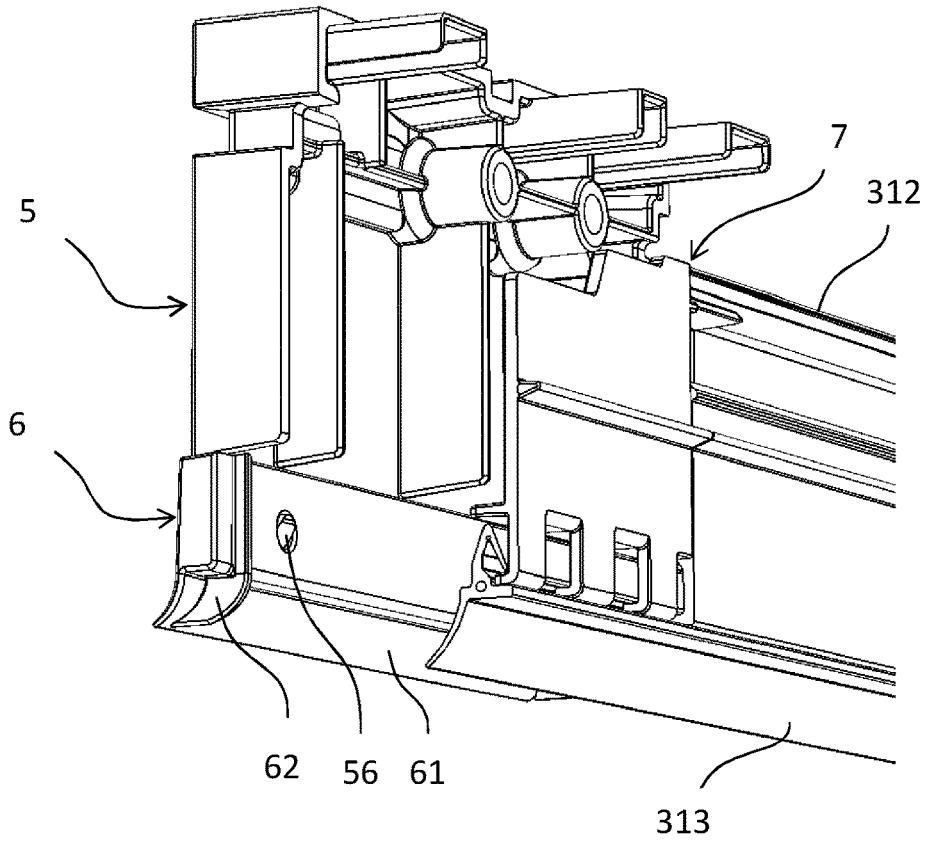

The covering plug 7 in shown alone FIGS. 11-12 and in combination with the covering gasket in FIGS. 13-14 and in FIGS. 15-16 it is shown together with the rest of the end closure 4, the second part 312 of the bottom covering 31 and the covering gasket 313.

As is seen the first section 71 comprises three hook-shaped projections 711 and two downwards projections 712, which are adapted to hook under and retain the covering gasket 313 so that it can project further than the second part 312 of the bottom covering, into the space on the inner side of the end plug 5. This projecting part of the covering gasket 313 extends in parallel with the end gasket 6 as is seen both in FIGS. 15-16 and in FIG. 4, thus providing a double sealing at the gap between the bottom covering 31 and the end plug 5. One of the side lips 62 on the end gasket closes off the gap between the two gaskets. Together the covering gasket and the end gasket provide a considerably improved water tightness compared to prior art solutions.

A plate-shaped part 713 of the first section 71 is adapted for abutting the flanges 53 on the inner side of the end plug 5 thereby forming a chamber between this plate-shaped part 713, the flanges 53 and the main body of the end plug 5. In FIGS. 15-16 the plate-shaped part 713 abut on two of the flanges and extending almost up to the third, thereby forming two chambers.

A ridge 714 on the opposite side of the plate-shaped part extends in continuation of a similar ridge on the second part 312 of the bottom covering.

Likewise, the second section 72 of the covering plug is shaped so that is corresponds to the shape of the second part 312 of the bottom covering as is best seen in FIG. 4. What is shown here is only one embodiment matching the shape of one type of the bottom covering and it will be understood the projecting parts on the second section 72 of the covering plug may be embodied in many different ways as long the they allow an interconnecting with the bottom covering. This applies both to their shape and to the number of projections. It is, however preferred that the second section includes three-dimensional projections as the ones shown, since this will provide good torsional strength to the joint between the covering plug and the covering.

LIST OF REFERENCE NUMBERS

1 First roof windows
2 Second roof window
3 Flashing assembly
30 Middle flashing member
31 Bottom covering
311 First part of bottom covering
312 Second part of bottom covering
313 Covering gasket
32 Cladding
321 Receivers
33 Connector flashing member
34 Cladding
35 Side flashing members
36 Side flashing members
37 Filler profile
4 End closure
5 End plug
51 Projections
52 Openings
53 Flanges
55 Engagement section
56 Projections
57 Opening
6 End gasket
61 Lip section

62 Side lip
65 Female connector section
66 Openings
611 Openings
7 Covering plug
71 First section
711 Hook-shaped projections
712 Downwards projections
713 Plate-shaped part
714 Ridge
72 Second section

The invention claimed is:

1. An end closure for a cladding for a first roof window forming part of a roof window arrangement mounted in an inclined roof structure, where said first roof window is above a second roof window when seen in a direction of inclination of the inclined roof structure and where a middle flashing member is arranged between the first roof window and the second roof window in a mounted state, said end closure comprising an end plug having an inner side intended to face the cladding in the mounted state, an outer side intended to face away from the cladding, an interior side intended to face an interior of a building covered by the inclined roof structure, an exterior side intended to face an exterior, and two side surfaces, which are substantially perpendicular to the inner side, the outer side, the interior side and the exterior side, and said end plug comprising a male connector section configured to be inserted in a hollow section of the cladding, the end closure further comprises an end gasket arranged at the interior side of the end plug and extending from one side surface to the other and being configured to come into a sealing engagement with the middle flashing member and wherein the end gasket and the end plug are separate components of said end closure and configured to engage one another when installed.

2. The end closure according to claim 1, where the end plug is provided with one or more flanges extending from the inner side.

3. The end closure according to claim 2, where the end gasket comprises one or more female connector sections fitting over an engagement section of the end plug.

4. The end closure according to claim 2, where the end gasket is provided with a lip section adapted for sealing engagement with the middle flashing member.

5. The end closure according to claim 2, further including a covering plug configured for interconnecting the end plug with a covering extending along a lower edge of the first roof window and comprising a male connector section configured to be inserted in a hollow section of the covering.

6. The end closure according to claim 1, where the end gasket comprises one or more female connector sections fitting over an engagement section of the end plug.

7. The end closure according to claim 6, where the engagement section is a flange extending in parallel with the outer side.

8. The end closure according to claim 7, where the end gasket is provided with a lip section adapted for sealing engagement with the middle flashing member.

9. The end closure according to claim 7, further including a covering plug configured for interconnecting the end plug with a covering extending along a lower edge of the first roof window and comprising a male connector section configured to be inserted in a hollow section of the covering.

10. The end closure according to claim 9, where the covering plug comprises an engagement surface configured to come into engagement with one or more flanges on the inner side of the end plug so that a space is formed between the covering plug and the end plug in the mounted state.

11. The end closure according to claim 10, where the covering plug comprises a covering gasket attachment section adapted for attachment of a covering gasket extending substantially in parallel with the end gasket in the mounted state.

12. The end closure according to claim 6, where the end gasket is provided with a lip section adapted for sealing engagement with the middle flashing member.

13. The end closure according to claim 6, further including a covering plug configured for interconnecting the end plug with a covering extending along a lower edge of the first roof window and comprising a male connector section configured to be inserted in a hollow section of the covering.

14. The end closure according to claim 1, where the end gasket is provided with a lip section adapted for sealing engagement with the middle flashing member.

15. The end closure according to claim 1, further including a covering plug configured for interconnecting the end plug with a covering extending along a lower edge of the first roof window and comprising a male connector section configured to be inserted in a hollow section of the covering.

16. The end closure according to claim 15, where the covering plug comprises an engagement surface configured to come into engagement with one or more flanges on the inner side of the end plug so that a space is formed between the covering plug and the end plug in the mounted state.

17. The end closure according to claim 16, where the covering plug comprises a covering gasket attachment section adapted for attachment of a covering gasket extending substantially in parallel with the end gasket in the mounted state.

18. An end closure for a cladding for a first roof window forming part of a roof window arrangement mounted in an inclined roof structure, where said first roof window is above a second roof window when seen in a direction of inclination of the inclined roof structure and where a middle flashing member is arranged between the first roof window and the second roof window in a mounted state, said end closure comprising an end plug having an inner side intended to face the cladding in the mounted state, an outer side intended to face away from the cladding, an interior side intended to face an interior of a building covered by the inclined roof structure, an exterior side intended to face an exterior, and two side surfaces, which are substantially perpendicular to the inner side, the outer side, the interior side and the exterior side, and said end plug comprising a male connector section configured to be inserted in a hollow section of the cladding, the end closure further comprises an end gasket arranged at the interior side of the end plug and extending from one side surface to the other and being configured to come into a sealing engagement with the middle flashing member and where the end plug and the end gasket are provided with matching engagement members.

19. The end closure according to claim 18, where the end gasket is provided with a lip section adapted for sealing engagement with the middle flashing member.

20. A roof window arrangement mounted in an inclined roof structure including at least a first roof window and a second roof window and a middle flashing member arranged between the first roof window and the second roof window, where the first roof window is mounted above the second roof window when seen in a direction of inclination of the inclined roof structure, said first roof window comprising a cladding and an end closure on the cladding, said end closure comprising an end plug having an inner side facing the cladding, an outer side facing away from the cladding, an interior side facing an interior of a building covered by the inclined roof structure, an exterior side facing an exterior, and two side surfaces, which are substantially perpendicular to the inner side, the outer side, the interior side and the exterior side, and said end plug comprising a male connector section inserted in a hollow section of the cladding, the end closure further comprises an end gasket arranged on the interior side of the end plug and extending from one side surface to the other and being in a sealing engagement with the middle flashing member.

* * * * *